US012140031B2

(12) United States Patent
Crompton et al.

(10) Patent No.: US 12,140,031 B2
(45) Date of Patent: Nov. 12, 2024

(54) DEFORMED HOLLOW ROCK BOLT

(71) Applicant: INNOVATIVE MINING PRODUCTS (PTY) LTD, Johannesburg (ZA)

(72) Inventors: Brendan Robert Crompton, Johannesburg (ZA); Rual Abreu, Johannesburg (ZA); Greig Knox, Johannesburg (ZA); Paolo Ettore Pastorino, Johannesburg (ZA)

(73) Assignee: INNOVATIVE MINING PRODUCTS (PTY) LTD, Johannesburg (ZA)

( * ) Notice: Subject to any disclaimer, the term of this patent is extended or adjusted under 35 U.S.C. 154(b) by 170 days.

(21) Appl. No.: 17/784,028

(22) PCT Filed: Dec. 9, 2020

(86) PCT No.: PCT/ZA2020/050069
§ 371 (c)(1),
(2) Date: Jun. 9, 2022

(87) PCT Pub. No.: WO2021/119679
PCT Pub. Date: Jun. 17, 2021

(65) Prior Publication Data

US 2023/0009400 A1 Jan. 12, 2023

(30) Foreign Application Priority Data

Dec. 9, 2019 (ZA) ..... 2019/08131
May 6, 2020 (ZA) ..... 2020/02462

(51) Int. Cl.
*E21D 21/00* (2006.01)
*E21D 20/02* (2006.01)

(52) U.S. Cl.
CPC ..... *E21D 21/0026* (2013.01); *E21D 20/02* (2013.01)

(58) Field of Classification Search
CPC ..... E21D 21/026; E21D 21/033
See application file for complete search history.

(56) References Cited

U.S. PATENT DOCUMENTS 4,955,219 A 9/1990 Josef et al.
6,033,153 A * 3/2000 Fergusson ..... E21D 21/0026 405/259.1

FOREIGN PATENT DOCUMENTS

AU 2016100070 3/2016
EP 0 247 778 12/1987
(Continued)

OTHER PUBLICATIONS

International Search Report for PCT/ZA2020/050069 dated Jul. 12, 2021, 6 pages.
(Continued)

*Primary Examiner* — Janine M Kreck
(74) *Attorney, Agent, or Firm* — NIXON & VANDERHYE

(57) ABSTRACT

Disclosed is a self-drilling resin anchored rock bolt with an elongate body of a suitable metal material extending between distal and proximal ends; and a drill bit engaged to the distal end; which body includes a threaded portion at the proximal end, a resin bore which extends through the elongate body, opening at each of the ends, a first integral anchor on the body, including integrally formed paddle formations; wherein the drill bit engaged with the body has a resin conduit which communicates an exterior of the drill bit with the resin bore; wherein the threaded portion has a first section, with a first thread density, extending from the proximal end, and a second section, with a second thread density, starting at the end of the first section and extending towards the distal end; and wherein the first thread density is lower than the second thread density.

6 Claims, 5 Drawing Sheets

(56) References Cited

FOREIGN PATENT DOCUMENTS

| | | | | |
|---|---|---|---|---|
| EP | 2758675 B1 * | 3/2017 | ..... | E21D 20/02 |
| WO | WO-2007059580 A1 * | 5/2007 | ..... | E21D 21/0026 |
| WO | WO-2015013743 A1 * | 2/2015 | ..... | E21D 20/00 |

OTHER PUBLICATIONS

Written Opinion of the ISA for PCT/ZA2020/050069 dated Jul. 12, 2021, 9 pages.

* cited by examiner

DEFORMED HOLLOW ROCK BOLT

CROSS-REFERENCE TO RELATED APPLICATIONS

This application is the U.S. national phase of International Application No. PCT/ZA2020/050069 filed Dec. 9, 2020 which designated the U.S. and claims priority to ZA Patent Application No. 2019/08131 filed Dec. 9, 2019, and ZA Patent Application No. 2020/02462 filed May 6, 2020, the entire contents of each of which are hereby incorporated by reference.

BACKGROUND OF INVENTION

Field of the Invention

The invention relates to a resin bolt adapted for use in supporting a rock wall by being grouted in a hole drilled into the rock wall.

Description of the Related Art

Current hollow bar resin bolt design relies on at least part of the external profile of the bolt providing anchorage with the encapsulating resin/grout. To ensure that there is sufficient anchorage between the bolt and the encapsulating resin to enable the bolt to be loaded to its tensile capacity, and with conventional profile, the bolt has to anchor along a relatively long length to achieve adequate anchorage.

A problem occurs when such a bolt is required to yield. Anchorage along a significant length of the bolt will impact on the ability of the bolt to elongate which is required for a bolt to absorb energy when subjected to dynamic loading once installed. To overcome the problem you need to minimise the anchor length preferably at each end of the bolt so that the unbonded length over which the bolt can elongate is maximised.

One of the solutions to the problem is to weld a smooth portion of hollow bar between two end portions of threaded bar. In this configuration, each end portion serves to anchor the bolt whilst the smooth middle portion yields. A downside to this solution is that welding affects the material properties of the steel, reducing the ultimate tensile capacity of the bolt. Another solution is to roll a thread portion onto each end of a smooth bar.

Hereinafter the terms "resin" and "grout" are interchangeably to refer to an adhesive material which has the effect of adhering a rock bolt into a rock hole.

The invention at least partially solves the aforementioned problems.

SUMMARY OF INVENTION

The invention provides a rock bolt for use in supporting a rock wall by being grouted in a rock hole drilled into the rock wall which includes an elongate body of a suitable metal material which extends between a distal end and a proximal end and which body includes a threaded portion at the proximal end, a resin bore which extends through the elongate body, opening at each of the ends, a first integral anchor at or towards the distal end that comprises a plurality of integrally formed paddle formations, a second integral anchor between the first integral anchor and the threaded portion that comprises a plurality of integrally formed paddle formations, and a stem portion between the first integral anchor and the second integral anchor which has a smooth cylindrical exterior surface.

The rock bolt may have an inner diameter (ID), being the diameter of the resin bore, to an outer diameter (OD), being the outer diameter of the elongate body, ratio in the range 1:1.8 to 1:3.0. Preferably, the ID to OD ratio is in the range 1:1.85 to 1:2.8; 1:1.9 to 1:2.8; 1:1:95 to 1:2.8 or 1:2.0 to 1:2.8.

In another aspect, the invention provides a self-drilling resin anchored rock bolt which includes an elongate body of a suitable metal material which extends between a distal end and a proximal end; and a drill bit engaged to the distal end; which body includes a threaded portion at the proximal end, a resin bore which extends through the elongate body, opening at each of the ends, a first integral anchor on the body, comprised of a plurality of integrally formed paddle formations; wherein the drill bit engaged with the body has a resin conduit which communicates an exterior of the drill bit with the resin bore; wherein the threaded portion has a first section, with a first thread density, extending from the proximal end, and a second section, with a second thread density, starting at the end of the first section and extending towards the distal end; and wherein the first thread density is lower than the second thread density.

The first thread density may be lower or coarser than the second thread density.

The first portion may have an R or T series thread and the second portion may have a metric or RD type thread.

The resin bolt may have an ID to OD ratio in the range 1:1.8 to 1:3.0. Preferably, the ID to OD ratio is in the range 1:1.85 to 1:2.8; 1:1.9 to 1:2.8; 1:1:95 to 1:1.28 or 1:2.0 to 1:2.8.

The invention extends to a method of manufacturing a hollow resin anchored rock bolt which includes the steps of:

a) providing a blank comprised of an elongate cylindrical body of a suitable metal material which has a bore which extends through the body, opening at each end of the body;
b) providing a pair of dies of a forming tool, each die including a pressing surface which is adapted with a channel which extends across the pressing surface;
c) placing the blank between the dies in axial alignment with the channels of each die; and
d) closing a space between the dies to a limiting position to press the blank at a first location to provide a first paddle formation so as not to decrease a cross-sectional area of the bore by more than 10%.

The method may include the additional steps of turning the blank about its elongate axis and repeating step (d) at a second location on the blank so as to provide a second paddle formation which is radially offset from the first paddle formation.

BRIEF DESCRIPTION OF THE DRAWINGS

The invention is described with reference to the following drawings in which.

DESCRIPTION OF PREFERRED EMBODIMENTS

Figure 1:
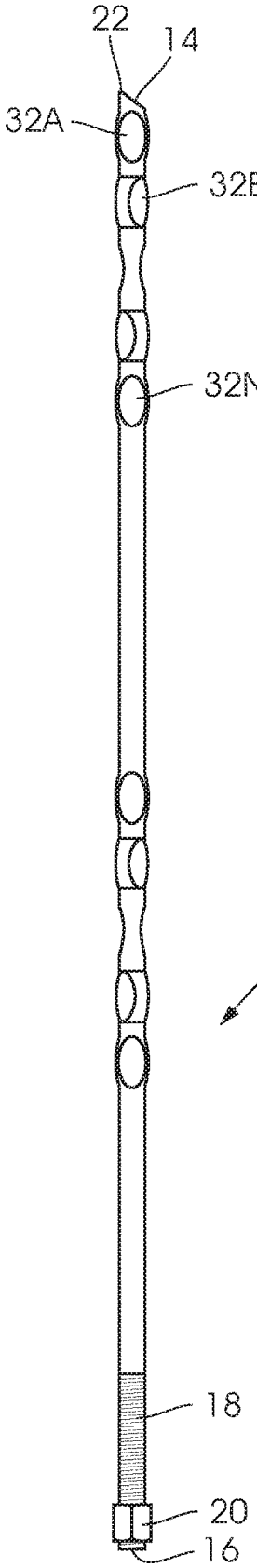
FIG. 1 is a view in elevation of a rock bolt according to the invention.
Figure 2A:
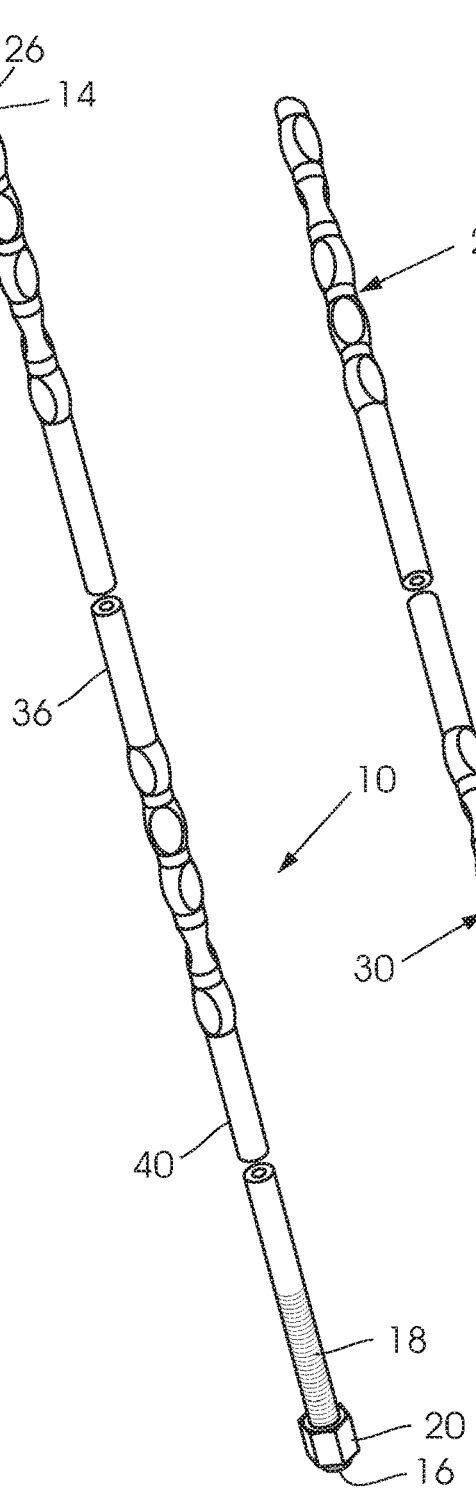
FIGS. 2A and 2B are views in perspective of the rock bolt of FIG. 1.
Figure 2B:
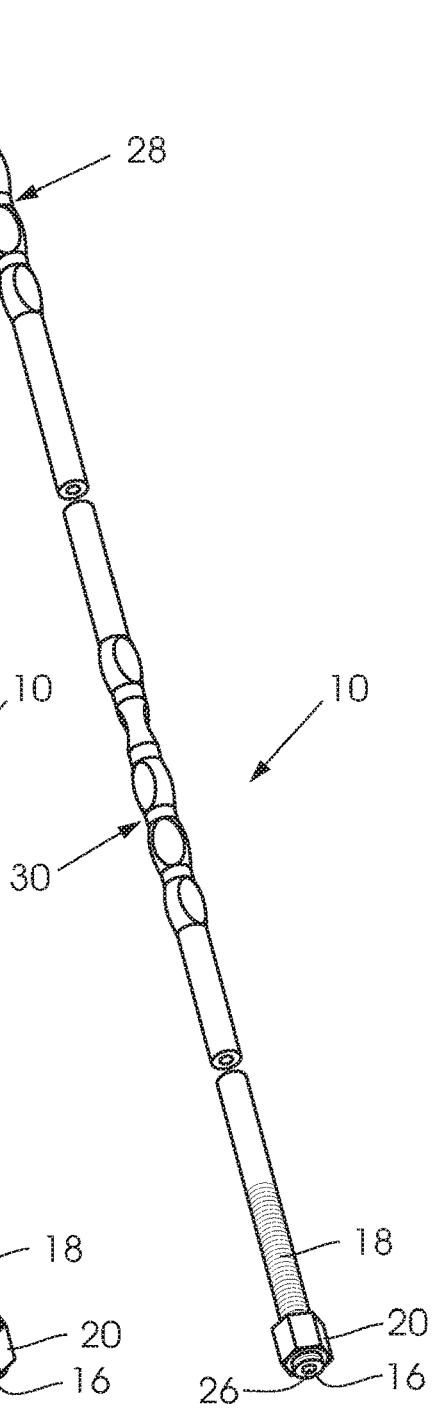

Referring to the FIGS. 1, 2A and 2B, a resin anchored rock bolt 10 is provided in accordance with the invention.

The bolt 10 has an elongate body 12, made of a suitable metal material, which extends between a first or leading end 14 and a second or trailing end 16. The body has a threaded end section 18 which terminates at the second end. The threaded section is formed with threads which are adapted to receive a nut 20 in threaded engagement thereon.

The leading end 14 can be shaped to a point 22, with the end surface being diagonally orientated relatively to the axis of the bolt body. Providing this point aids in pushing the bolt into a pre-drilled rock hole. A leading edge 24 can be bevelled to further reduce resistance to the bolt's passage into the rock hole.

The rock bolt body 12 is hollow, formed with a resin bore 26 which extends between, and opens at, the ends (14, 16). It is through this bore that a resin is pumped from the distal end 16, in use of the bolt.

The rock bolt 10 is adapted with a first and a second integral anchor, respectively designated 28 and 30, to anchor the bolt within the rock hole, after a resin is introduced into the rock hole through the bore 26 and hardens. Each of these integral anchors is designed to resist passage through a column of hardened resin which fills the annular space between the bolt and rock hole wall.

In describing the integral anchors (28, 30), for ease of description, reference is made to the first integral anchor. Although, the description that follows equally applies to the second integral anchor.

The first integral anchor 28 is formed from the same smooth surface hollow blank as the body and will be described below in greater detail. The anchor comprises, for example, a set of four or five end-to-end paddle formations, respectively designated 32A, 32B . . . 32N. Each paddle formation lies in a plane which, for a five set paddle formation anchor for example, is radially offset from adjacent paddle formations by 45°. It is anticipated within the scope of the invention, that the integral anchor is comprised of any number of paddle formations. If, for example, there are four paddle formations making up the anchor (28 or 30), then each formation will be radially offset from adjacent formations by 60°.

Each paddle formation 32 is formed by pressing the body 12 of the bolt 10, between a pair of dies, respectively designated 34A and 34B (see FIG. 3 or 4), such that the bolt body expands in opposed directions which are orthogonal to the direction of the flattening force (these directions of expansion are designated X and Y respectively). This compressive cold forming process strain hardens the steel material along the length of the integral anchor 28 and adapts the bolt body to locally exceed its diameter in radial directions X and Y respectively, providing projections which are resistive to pull through a resin grouted rock hole.

Once the integral anchors (28, 30) are formed, a first stem portion 36 and a second stem portion 40 are defined between the first integral anchor 28 and the second integral anchor 30, and the second integral anchor and the second end 16 respectively. The stem portions retain the smooth cylindrical exterior of the original blank. Having a non-resistive exterior, the stem portions will move axially relatively to the rock hole in use of the bolt 10 to accommodate the body 12 stretching—under passive load exerted on a faceplate (not shown) mounted on the rock bolt body 14 ahead of the nut 20—whilst the integral anchors locally anchor the bolt, substantially preventing any relative axial movement therealong.

The problem with forming the paddle formations 32 as described is that in compressing the bolt body 14, the resin bore 26 will partially change shape from circular to ovoid. In this shape-changing process, the bore may become partially occluded due to a reduction in the cross-sectional area of the bore, reducing the flow rate of the resin through the bore. With a quick setting resin, this reduction in the flow-rate is particularly problematic as the resin could set, or partially set, within the bore.

The solution to the problem lies in the configuration of the blank that is used and the dies that are used to compress the blank to form the paddles formations.

Regarding the configuration of the blank, a hollow bolt body 14 needs to be chosen that has sufficient material in a wall of the body to form the paddles whilst providing the bolt with as large a diameter bore as possible without compromising on the bolt's load bearing capacity. To achieve a compromise between bore diameter and strength, the applicant has found that ratio of the ID to OD must be in the range 1:1.8 to 1:4.5. Preferably, the ID to OD ratio is in the range 1:1.8 to 1:3.0, more preferably 1:1.87 to 1:2.8. In one example of the rock bolt, the OD is 28 mm and the ID is 10 mm. In another, the OD is 28 mm and the ID is 15 mm. In a third example, the OD is 32 mm and the ID is 16 mm.

Figure 3:
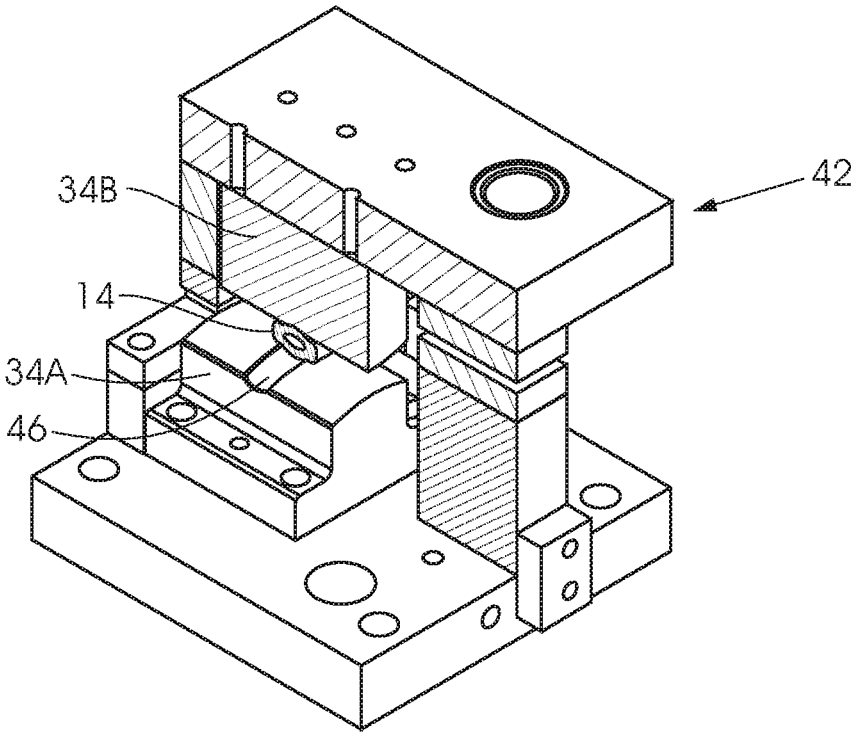
FIGS. 3 and 4 illustrate a press used to form the rock bolt in accordance with a method of the invention, and the rock bolt passing through the press.
Figure 4:
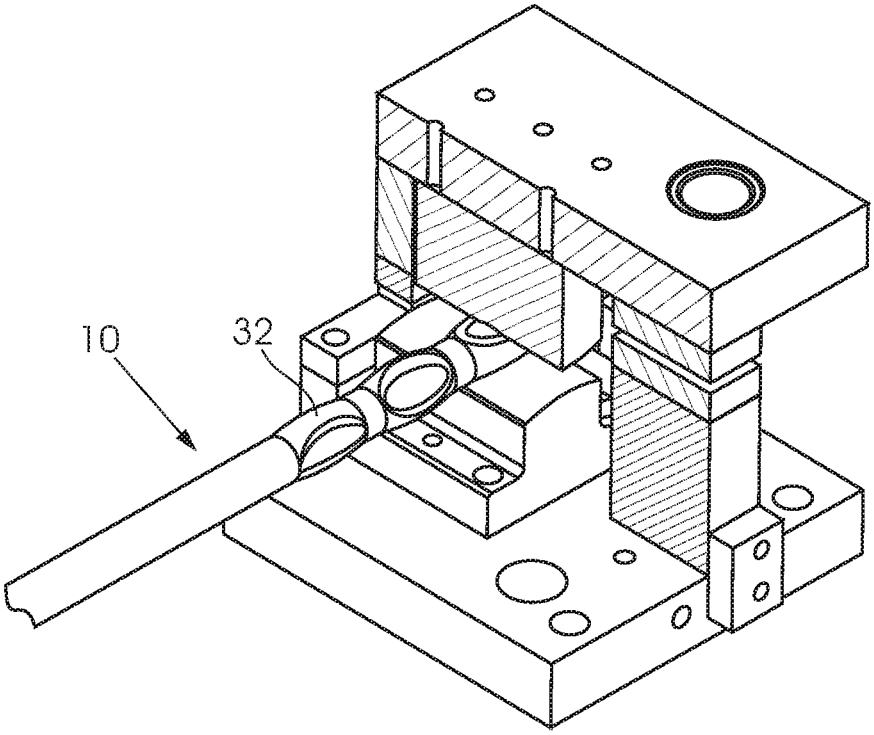
Figure 6:
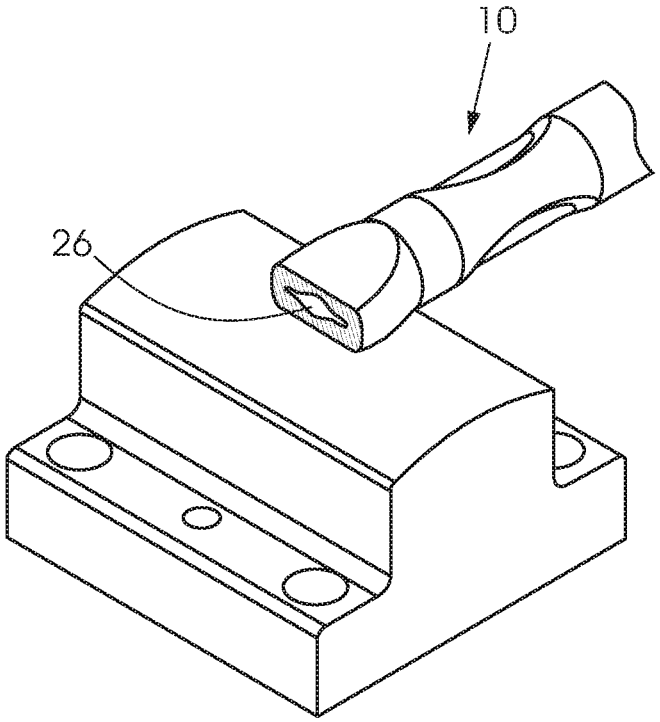
FIG. 6 illustrates a lower die in accordance with the prior art.
Figure 7:
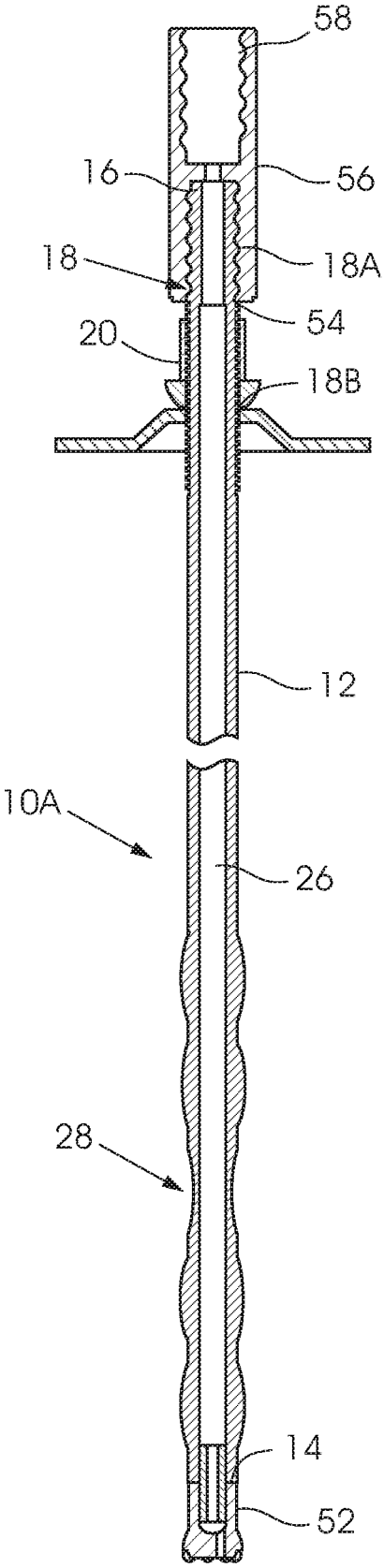
FIG. 7 is a view in longitudinal section of a rock bolt in accordance with the other aspect of the invention, to which is engaged a drill adapter.
Figure 8:
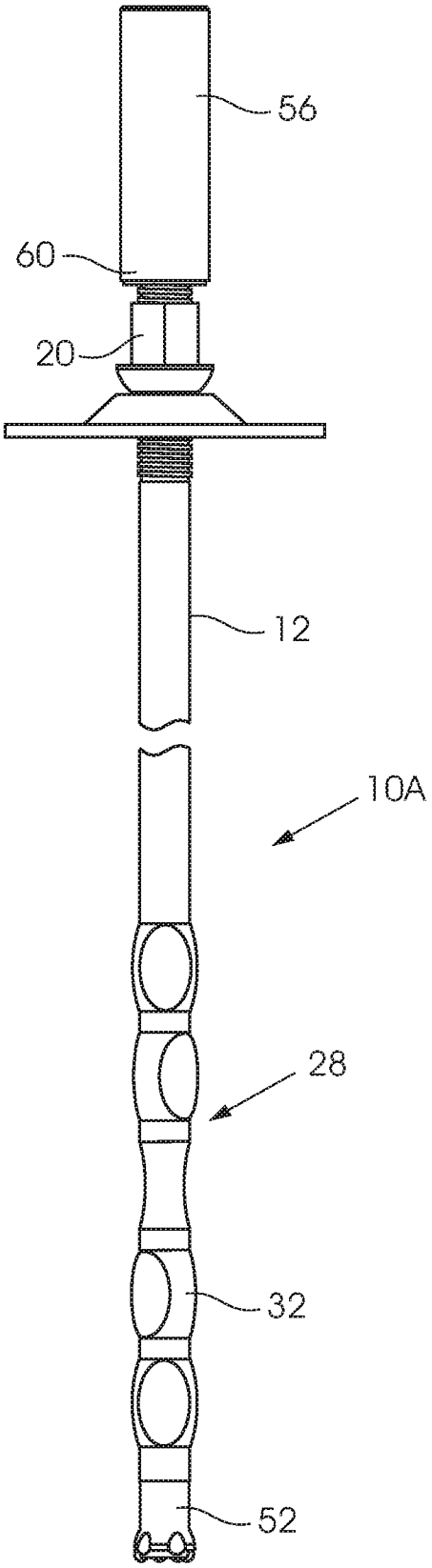
FIG. 8 is a view in elevation of the rock bolt of FIG. 7.

In the forming method, to provide the paddle formations 32, which method is illustrated in FIGS. 3 and 4, the pair of dies 34 is used in a press 42. Each die has a convex pressing surface 44 which acts upon the bolt body 14 blank, when the dies are forced into compression, to form the paddle formations. However, the applicant has found that if a standard set of dies, which are not suitably adapted, is used in the forming method, the effect will be an occluded, or partially occluded, resin bore 26. This effect is illustrated in FIG. 6.

In order to limit the deformation of the bore 26, each die 40 is adapted with a channel 46 which runs across the pressing surface 44 in a direction that is axial to the orientation of the bolt body 14 blank when it is inserted between the dies. The channel width is significantly (+/−50%) less than the width of the blank. With the dies attached to the press, the channels 46 vertically align.

Figure 5:
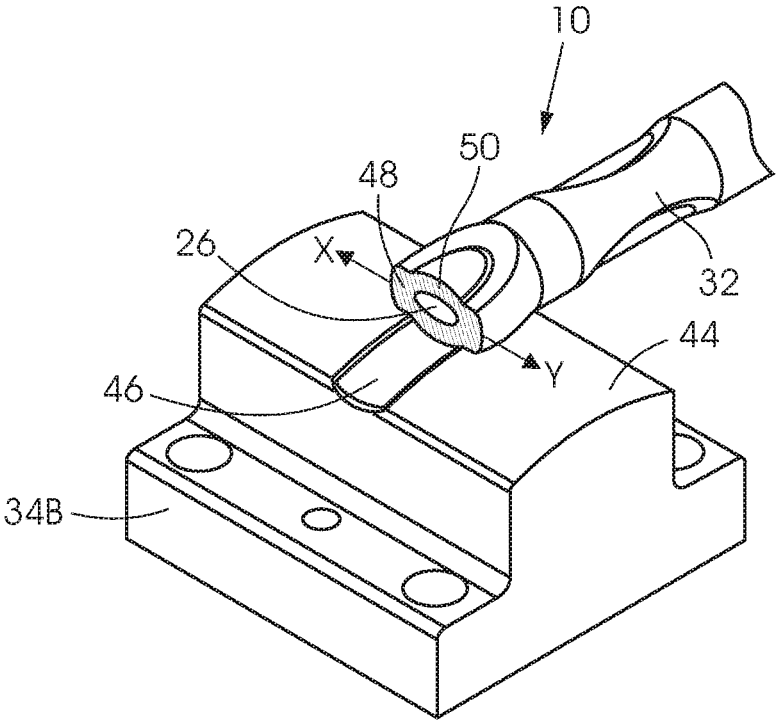
FIG. 5 illustrates a lower die, of the press, adapted in accordance with the invention.

During the forming process, the bolt body 14 blank is inserted between the dies, in axial alignment with the channels 46. When the dies are brought together in the pressing action, the parts of the blank which extend beyond the width of the channel (hereinafter, the side parts 48) are squeezed laterally into forming a respective projection of a paddle formation 32. The centre part 50 of the blank, lying substantially within the width of the channels 45, is not exposed to full deformation between the closing dies, due to the space provided by the channels. And, although the centre part is deformed from a circular to an avoid shape, and so too the resin bore (see FIG. 5), the cross-sectional area of this ovoid bore is not significantly less than the original circular bore. Had the dies not been so adapted, the centre part would have been flattened along with the side parts as illustrated in FIG. 6, collapsing or partially collapsing the resin bore and materially reducing the cross-sectional area.

The extent to which the dies close is limited by an internal mechanical stopper mechanism inherent in the process tooling or through use of electro-mechanical instrumentation and control. By adjusting the internal stopper mechanism, the pressing step can be controlled to stop with the dies set apart by a certain distance so as not to produce close the resin bore completely.

A resin anchored rock bolt 10A in accordance with the other aspect of the invention is illustrated in FIGS. 7 to 10. In describing this rock bolt, like features, relative to rock bolt 10, bear like designations.

The essential differences between this bolt 10A and the earlier described bolt 10 is that bolt 10A is self-drilling, provided with a drill bit 52 which is engaged to the leading end 14 of the bolt body 12, and has a single integral anchor 28 which extends along a leading end portion of the body, terminating at the leading end.

In one variant of the bolt 10A, the threaded section 18 has a thread of a single thread density. In another variant, the threaded end the threaded end section 18 is divided into a first portion 18A, of a first thread density, and a second portion 18B, of a second thread density. The first portion extends from the trailing end 16, to a mid-point 54, and the second portion extends towards the leading end, from the mid-point.

The first thread density is significantly lower or coarser than the second thread density. For example, the first portion may have an R or T series thread such as a 28, 32, 38 or 45 thread, adapted for optimal transfer of energy during a percussive drilling step. The second portion may have a metric or RD type thread, for better axial load hold.

The nut 20 is threadedly engaged with the threads on the second portion 18B.

In use, an adapter 56 (such as that described in 2020/00977 which specification is herein incorporated by reference) is engaged, at one end 58, to a shaft of a rock drill (not shown) and, at the other end 60, to the threads of the first portion 18A of the threaded end section 18 of the rock bolt body.

Actuating the drill will cause the rock bolt 10A to spin and, with the drill bit 52 forced against a rock wall (not shown), to drill a hole in the rock.

Figure 9:
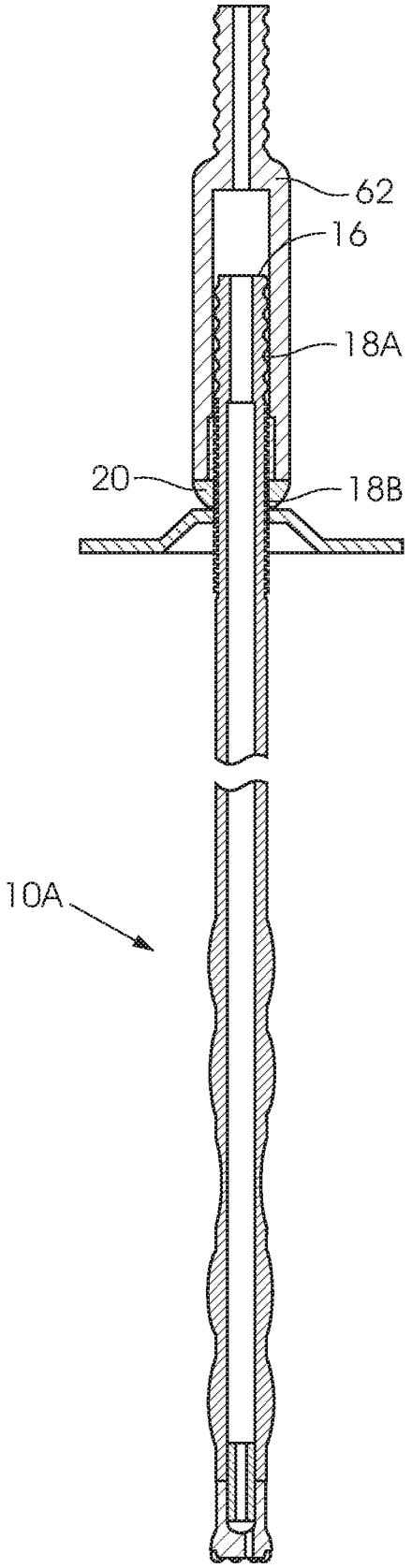
FIG. 9 is a view in longitudinal section of the rock bolt of FIG. 7, to which is engaged a tensioning adapter.
Figure 10:
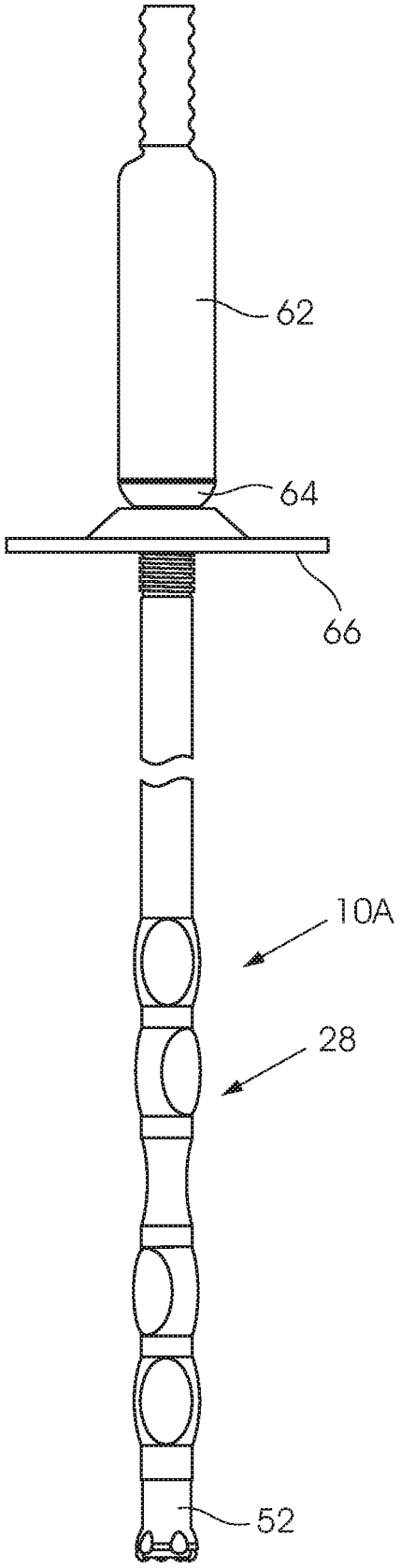
FIG. 10 is a view in elevation of the rock bolt of FIG. 9.

Once the rock hole is created with the self-drilling action of the rock bolt 10A, the adapter can be relatively easily disengaged from the rock bolt, by reversing the rotational direction of the rock drill, as the threads of the first portion 18A do not have a high torque to axial load ratio. Because of this low tensile strength, these threads would not be suitable for holding the load applied axially to the bolt by rock movement once the bolt is installed and grouted in the rock hole With the adapter disengaged, a tensioning tool 62 is indexed into place. This tool, as illustrated in FIGS. 9 and 10, is adapted to receive the end section 18 of the bolt body 12 within, such that the nut 20 locates within a spanner formation in a forward end 64 of the tool.

Because of the finer thread density of the threads of the second portion 18B, there is a higher torque to axial load ratio than the counterpart threads of the first portion 18A. However, this does not cause a problem with disengagement of the tensioning tool because this tool is not threadedly engaged. Having a higher thread density however does provides greater axial strength which is necessary as the reactive axial load, after tensioning, is placed on the nut.

The invention claimed is:

1. A self-drilling resin anchored rock bolt which includes an elongate body of a metal material which extends between a distal end and a proximal end, a threaded portion at the proximal end, a resin bore which extends through the elongate body, opening at each of the ends, a first integral anchor on the body, comprised of a plurality of integrally formed paddle formations, and a drill bit engaged to the distal end that has a resin conduit which communicates an exterior of the drill bit with the resin bore, wherein the threaded portion has a first section, with a first thread density, extending from the proximal end, and a second section, with a second thread density, starting at the end of the first section and extending towards the distal end; and wherein the first thread density is lower than the second thread density.

2. The self-drilling resin anchored rock bolt according to claim 1, wherein the first thread density is lower or coarser than the second thread density.

3. The self-drilling resin anchored rock bolt according to claim 2, wherein the first portion has an R or T series thread and the second portion has a metric or RD type thread.

4. The self-drilling resin anchored rock bolt according to claim 1, wherein a resin bore diameter to an outer diameter of the elongate body ratio is in the range 1:1.8 to 1:3.0.

5. The self-drilling resin anchored rock bolt according to claim 2, wherein a resin bore diameter to an outer diameter of the elongate body ratio is in the range 1:1.8 to 1:3.0.

6. The self-drilling resin anchored rock bolt according to claim 3, wherein a resin bore diameter to an outer diameter of the elongate body ratio is in the range 1:1.8 to 1:3.0.

* * * * *